US006763119B2

(12) United States Patent
Lee

(10) Patent No.: US 6,763,119 B2
(45) Date of Patent: Jul. 13, 2004

(54) NECKPHONE

(75) Inventor: Chun-Bong Lee, Pusan-shi (KR)

(73) Assignee: Neckphone Co., Ltd., Pusan-shi (KR)

( * ) Notice: Subject to any disclaimer, the term of this patent is extended or adjusted under 35 U.S.C. 154(b) by 0 days.

(21) Appl. No.: 09/980,344

(22) PCT Filed: Nov. 30, 2000

(86) PCT No.: PCT/KR00/01383

§ 371 (c)(1),
(2), (4) Date: Nov. 30, 2001

(87) PCT Pub. No.: WO01/93630

PCT Pub. Date: Dec. 6, 2001

(65) Prior Publication Data

US 2003/0012394 A1 Jan. 16, 2003

(30) Foreign Application Priority Data

May 27, 2000 (KR) ..... 2000-15354
Jul. 3, 2000 (KR) ..... 2000-39735
Nov. 11, 2000 (KR) ..... 2000-66929

(51) Int. Cl.[7] ..... H04R 25/00

(52) U.S. Cl. ..... 381/385; 381/380; 381/375; 381/377; 381/379; 381/386

(58) Field of Search ..... 381/385, 386, 381/87, 374, 371, 375, 377, 378, 379; 455/100; 379/449, 430

(56) References Cited

U.S. PATENT DOCUMENTS 6,091,832 A * 7/2000 Shurman et al. ..... 381/381

* cited by examiner

*Primary Examiner*—Curtis Kuntz
*Assistant Examiner*—Tuan Duc Nguyen
(74) *Attorney, Agent, or Firm*—Cha & Reiter, LLC

(57) ABSTRACT

The present invention relates to a neckphone which is a simple neck-wearing type and allows a person to hear a sound outputted from a sound media as a 3D stereophonic sound provided by a rear sound in addition to a front sound.

In order to achieve the above object, the neckphone according to the present invention is characterized in that it includes a U-shaped or C-shaped supporting brace. Alternatively, the neckphone is characterized in that it includes a ∪-shaped supporting brace G4 and speaker portions Sp1 and Sp2, and that the ∪-shaped supporting brace G4 includes a first curved portion Ga coupled with the speaker portions, second curved portions Gb extending from both sides of the first curved portion and taking the shape of the neck curve, and third curved portions extending from both sides of said second curved portions, taking the shape of the chest curve and having a radius of R3.

32 Claims, 15 Drawing Sheets

NECKPHONE

TECHNICAL FIELD

The present invention relates to a neckphone, more particularly to a neckphone used together with front speakers so that a person can hear 3D sound even in a narrow space.

BACKGROUND ART

The term "neckphone" is a concept similar to a headphone and corresponds to an acoustical appliance that is placed on the neck. Further, the term "3D sound" is often called stereophonic sound and is referred to as a system or technique for producing realistic sound.

As shown in FIG. 1, stereophonic sounds were conventionally produced in a manner that specific sounds are outputted from respective speakers using a plurality of ordinary speakers S. That is, the stereophonic sounds are perceived when a person is located at a central location to the speakers which are disposed in a square pattern at the four corners of a room to an extent of the height of the person's ear. However, such a method requires considerable space for installation of the speakers. Further, this method cannot attain a satisfactory effect of the 3D sound within a narrow space, even though the speakers are disposed at the front and rear areas of the room.

Another method for producing the stereophonic sounds is to use a headphone that is capable of outputting the 3D stereophonic sound. In this method, however, there are problems stemming from limited sound quality and the user feeling of a sense of fatigue and pain when the headphone is used for a long period of time since it presses on the ears.

Recently, as virtual space 3D strategic simulation games and so forth rise in popularity, the users are encouraged to experience a more realistic sound. Therefore, the need for a device that can provide the 3D sound while using the conventional speakers in the same way as before is on the rise.

DISCLOSURE OF INVENTION

The present invention is conceived to solve the problems mentioned above. The object of the invention is to provide a device that allows a user to feel 3D stereophonic sound in a manner that a rear sound can be obtained by simply putting the device on his neck in addition to a front sound from the conventional speakers.

In order to achieve the above object, a neckphone according to the present invention is characterized in that it includes a U-shaped or C-shaped supporting brace and the speakers coupled with the supporting brace and that the supporting brace has an ergomechanics-based, curved portion.

In addition, the neckphone may further include at least one folding portion for coupling the U-shaped or C-shaped supporting brace for providing mobility of the supporting brace.

Furthermore, the neckphone may include a first supporting brace and a second supporting brace coupled with the first supporting brace.

Moreover, the neckphone may include microphones and a speaker portion thereof has a structure in that a low frequency contained in an audio signal for reproducing a sound can generate a vibration.

Hereinafter, preferred embodiments of the present invention will be explained in detail with reference to the accompanying drawings.

BEST MODE FOR CARRYING OUT THE INVENTION

The present invention is mainly based on the tests for a person's perceptual capability with respect to the sounds generated from his front and rear locations. A sound card named "Soundtrack PCI" available from Hoontech Co., Ltd. and a program, having a function of 3D Doppler sound, annexed to the sound card were used in the present invention.

Figure 2:
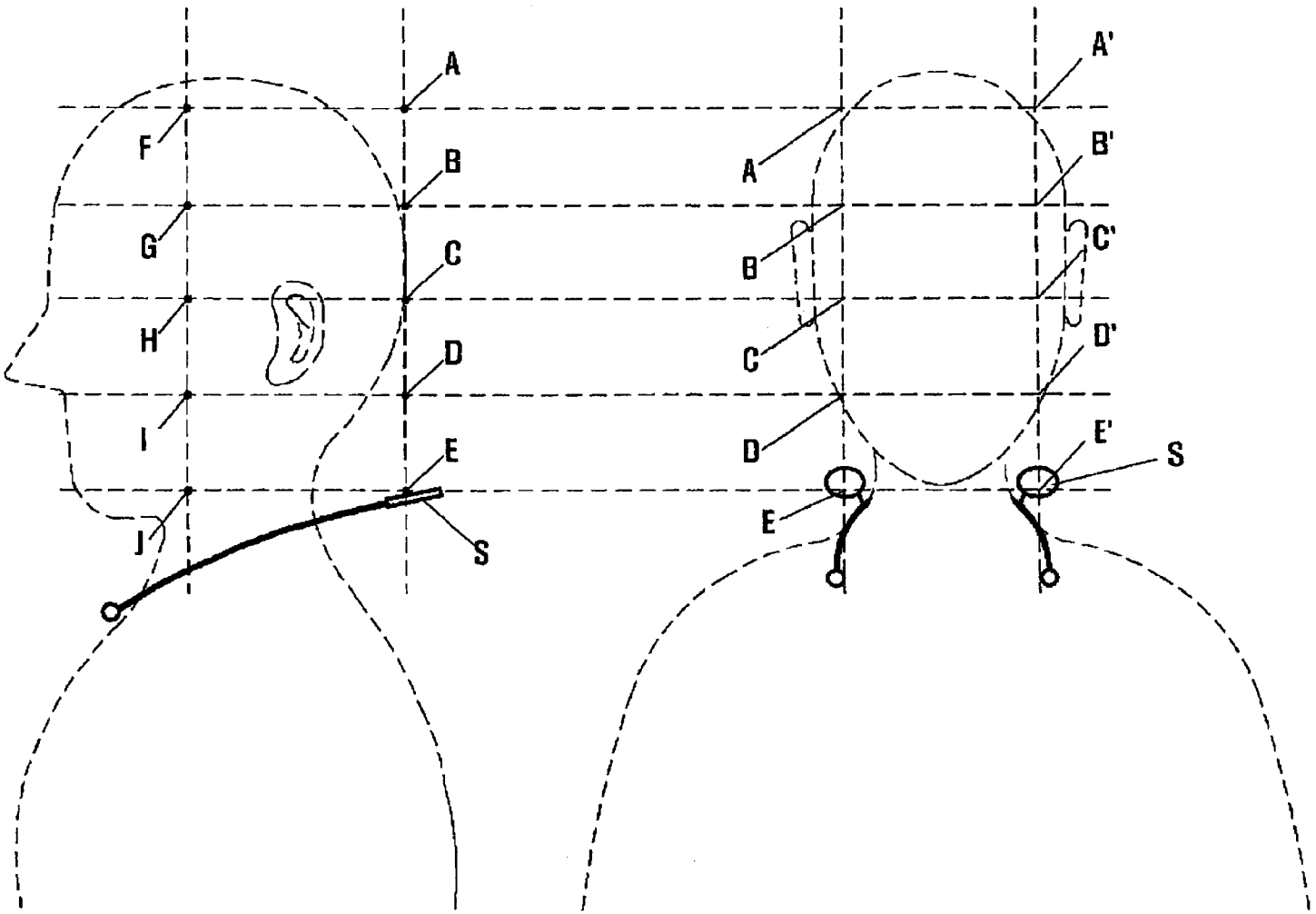
FIG. 2 is a view illustrating a method for testing a sound effect on a person in order to find out optimal locations of the speakers according to the present invention.
Figure 3:
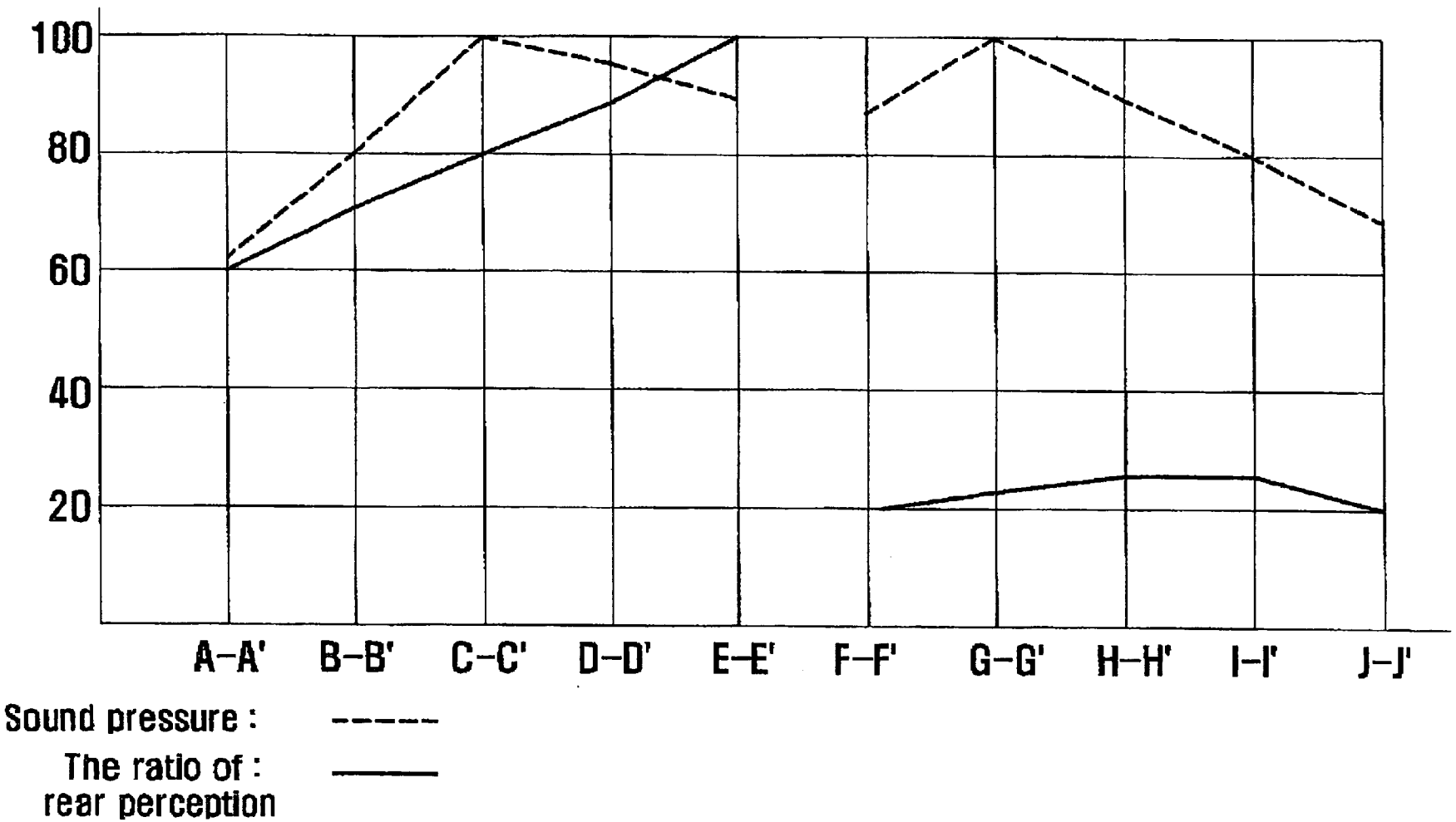
FIG. 3 is a graph showing the results according to the tests for the ratio of rear perception and sound pressure with respect to the respective reference points.

The test for the ratio of rear sound perception and sound pressure perception were conducted while sequentially locating the other two speakers S along the locations of the tester A–A', B–B', C–C', D–D', E–E', F–F', G–G', H–H', I–I' and J–J' as shown in FIG. 2, after two small speakers were first installed in the front of a tester. At this time, samples having same sound sources are simultaneously provided to both the two front speakers and the other two speakers positioned at the above respective locations. The test results are shown in FIG. 3.

The sound source samples are 30 dB-4Way continuous sounds. The results obtained from the tests for perceiving sound source points, rotating sounds and sound pressures are as follows:

1. Sound source locations of a near sound having an intensity below 10 dB could not be determined since this sound is not or weakly propagated to the other ear.
2. In order to correctly determine the locations of the front sounds, it is required that the front speakers be spaced apart approximately 1 m from a front face of the tester. Further, the locations of the front sound sources positioned between the ranges of 45 degrees toward the left and right directions cannot be determined within the distance of 25 cm.

3. Ear's performance in determining the sound source with respect to the rear sound is maximal at the E—E' location as shown in FIG. 3.

It can be understood from the above test results that the ear's performance in determining a sound source at a rear position is higher than that at a front position within a short distance as described in test result no. 2. The front sound needs to have a considerable distance as in the test result no. 2. Therefore, it can be understood that separate 2-Way speakers should be installed at the front position of approximately 1 m and a device for providing the rear sound should be positioned at E—E' location so that the person can feel the 3D sound.

In summary, the neckphone according to the present invention is constructed to reproduce the sound at a location where the rear sounds can be maximally perceived, and can attain a 3D sound having a perfect perception ratio of the front and rear sound sources by providing the rear sound from behind the ear as well as the front sound from the front speakers.

Figure 1:
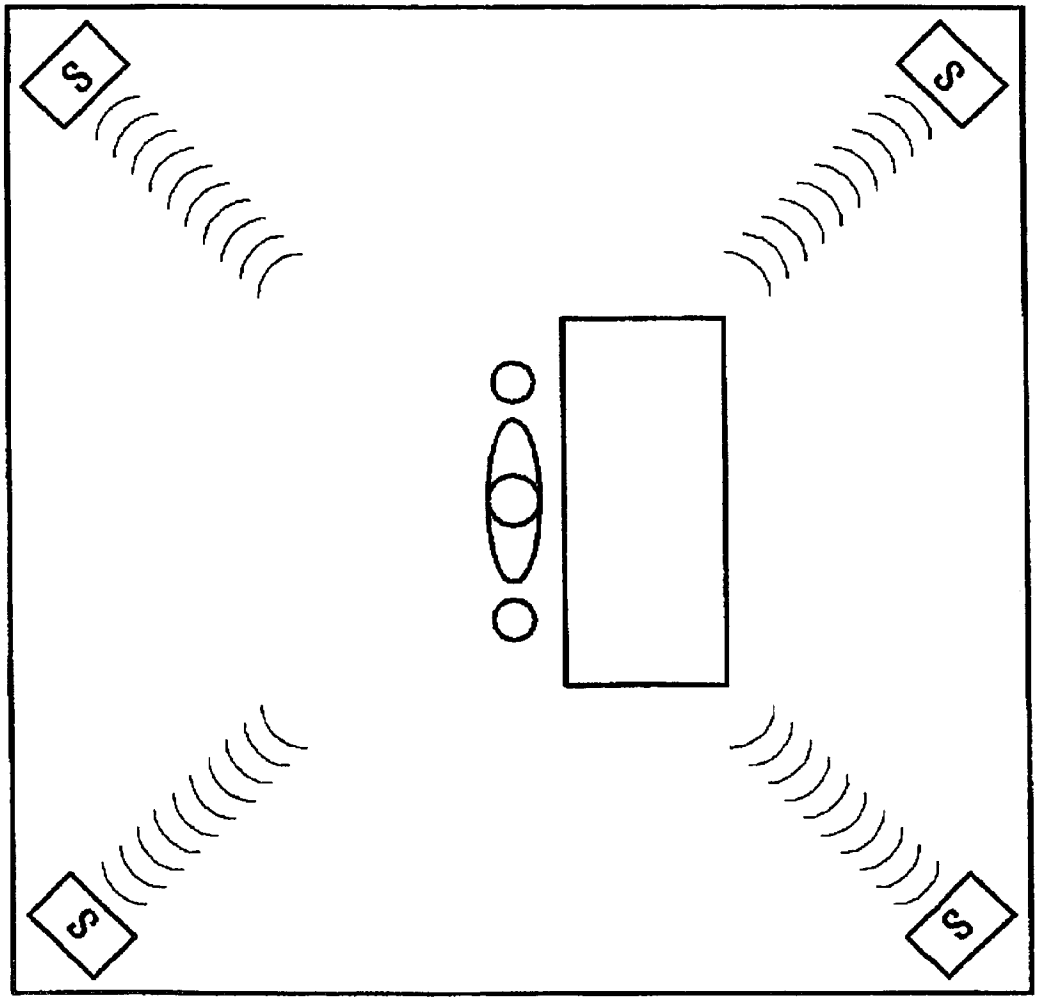
FIG. 1 is a view illustrating a method for providing a sound according to the prior art.
Figure 4:
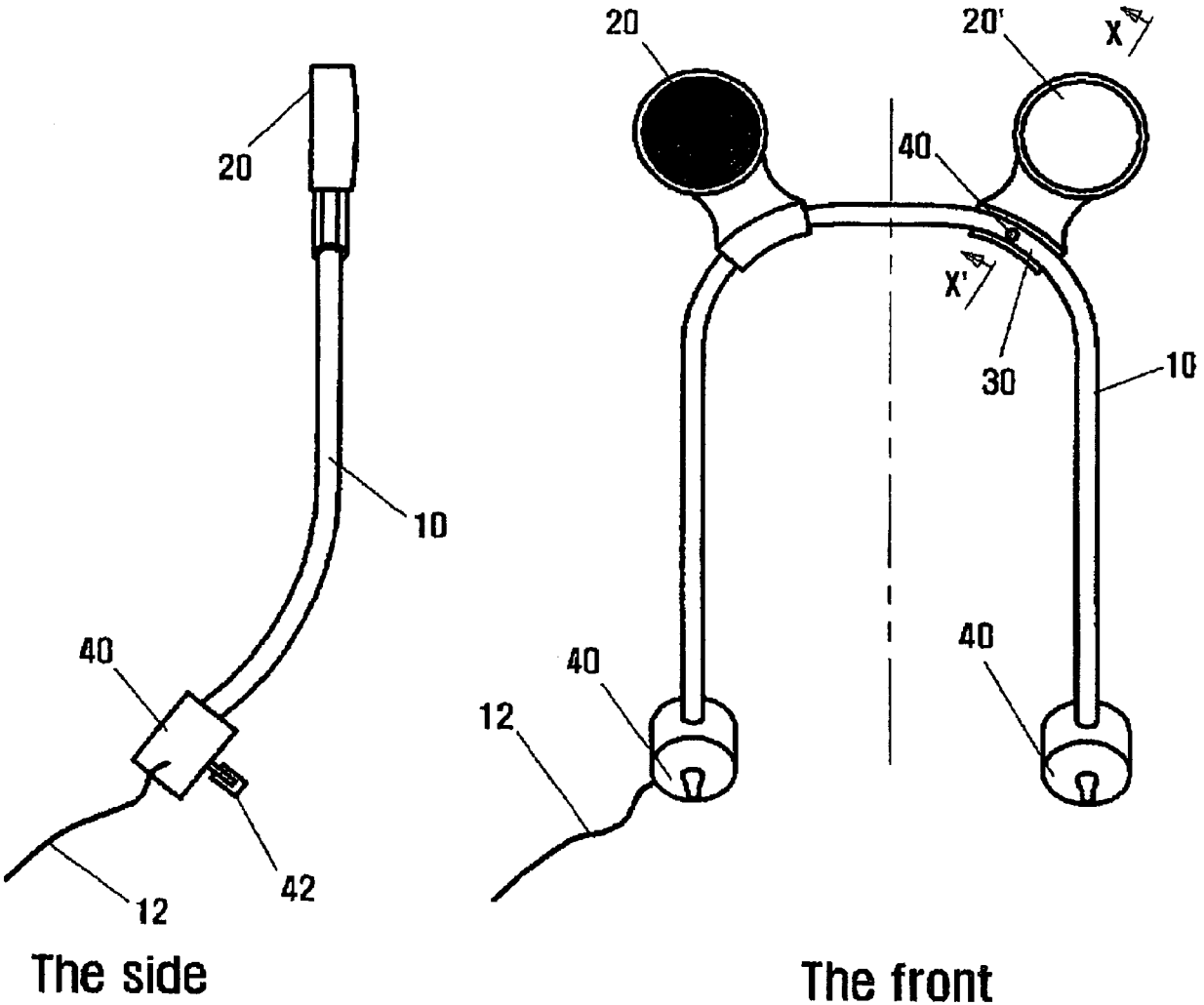
FIG. 4 is a structural view of the neckphone according to a first embodiment of the present invention.
Figure 5:
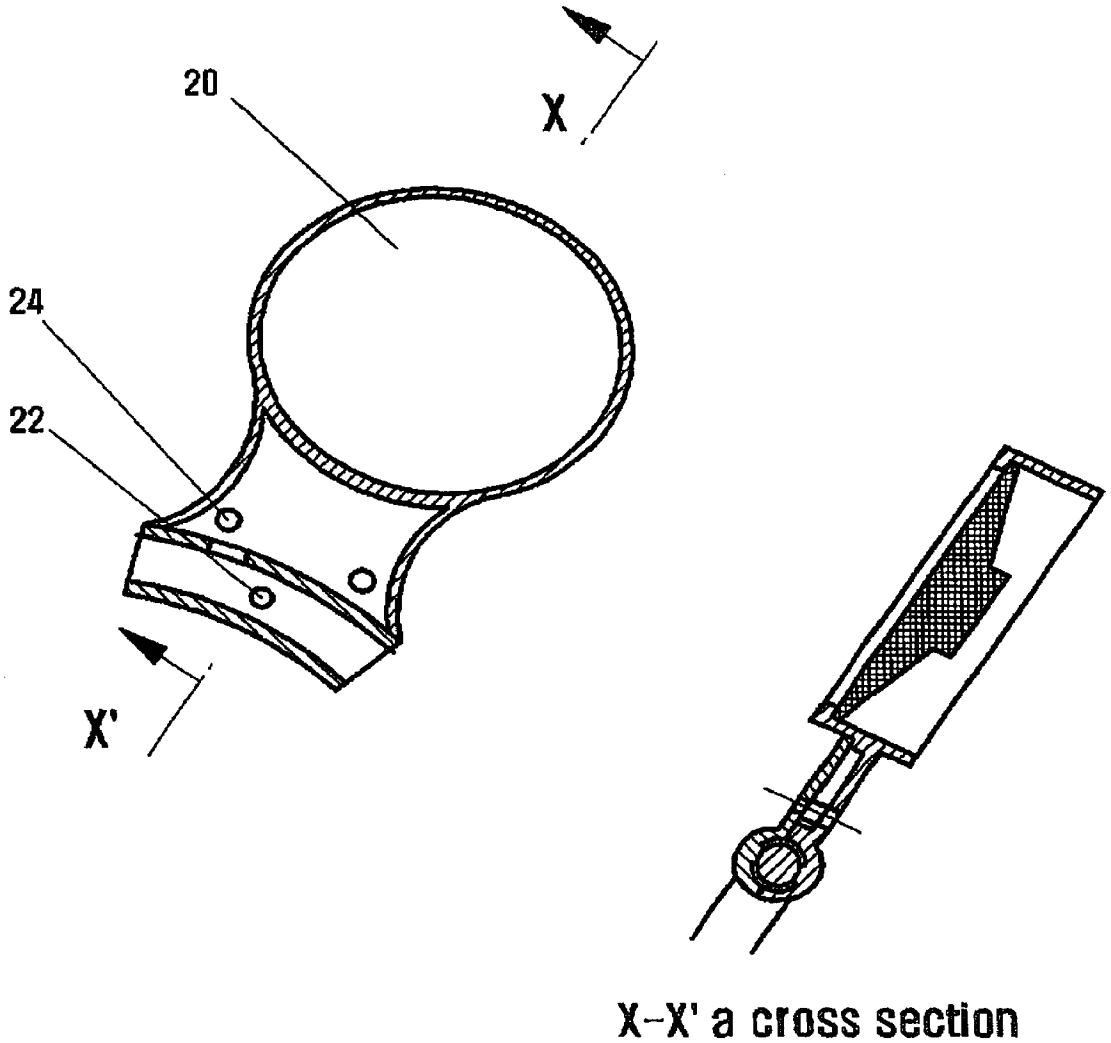
FIG. 5 is a view illustrating the coupling of a speaker portion with supporting braces of FIG. 4.

FIG. 4 is a structural view of the neckphone according to the first embodiment of the present invention, wherein (A) is a front view thereof and (B) is a side view thereof. The neckphone of FIG. 4 comprises a U-shaped supporting brace 10, speakers 20 and 20', a first coupling portion 30 for coupling the speakers 20 and 20' with the supporting brace 10, a second coupling portion 40 for securing a speaker line 12 into the supporting brace 20, and a counterbalancing portion 40' disposed on the side opposite to the second coupling portion 40 in order to prevent imbalance in the center of gravity of the neckphone due to the connection of the speaker line. The supporting brace 10 is in the form of a pipe or hollow structure through which wiring can pass. The supporting brace is also particularly designed to conform to the person's contour and is able to be put on in the form of a necklace, as shown in FIG. 1(A). In addition, the speakers 20 and 20' generate the surround-sound, e.g., 3D sound by producing the sound from behind the ear and by working the rear sound with the sound from conventional speakers (not shown). Therefore, it is preferred that the placement of the speakers 20 and 20' be behind the ear. The first coupling portion 30 couples the supporting brace with the speaker by engaging a concavo-convex portion 22 and a screw-tightened portion 24 as shown in FIG. 5, with a groove 14 of the supporting brace. The second coupling portion 40 secures the speaker line into the supporting brace by engagement of the supporting brace 10 with a screw-tightened portion 42 attached to the coupling portion. On the other hand, if the second coupling portion 40 is connected to the speaker line, imbalance of the neckphone may occur due to inclination of the neckphone caused by the speaker line. The counterbalancing portion 40' can avoid the above problem. Preferably, the counterbalancing portion 40' is made from heavier material as compared to the second coupling portion 40.

Figure 6:
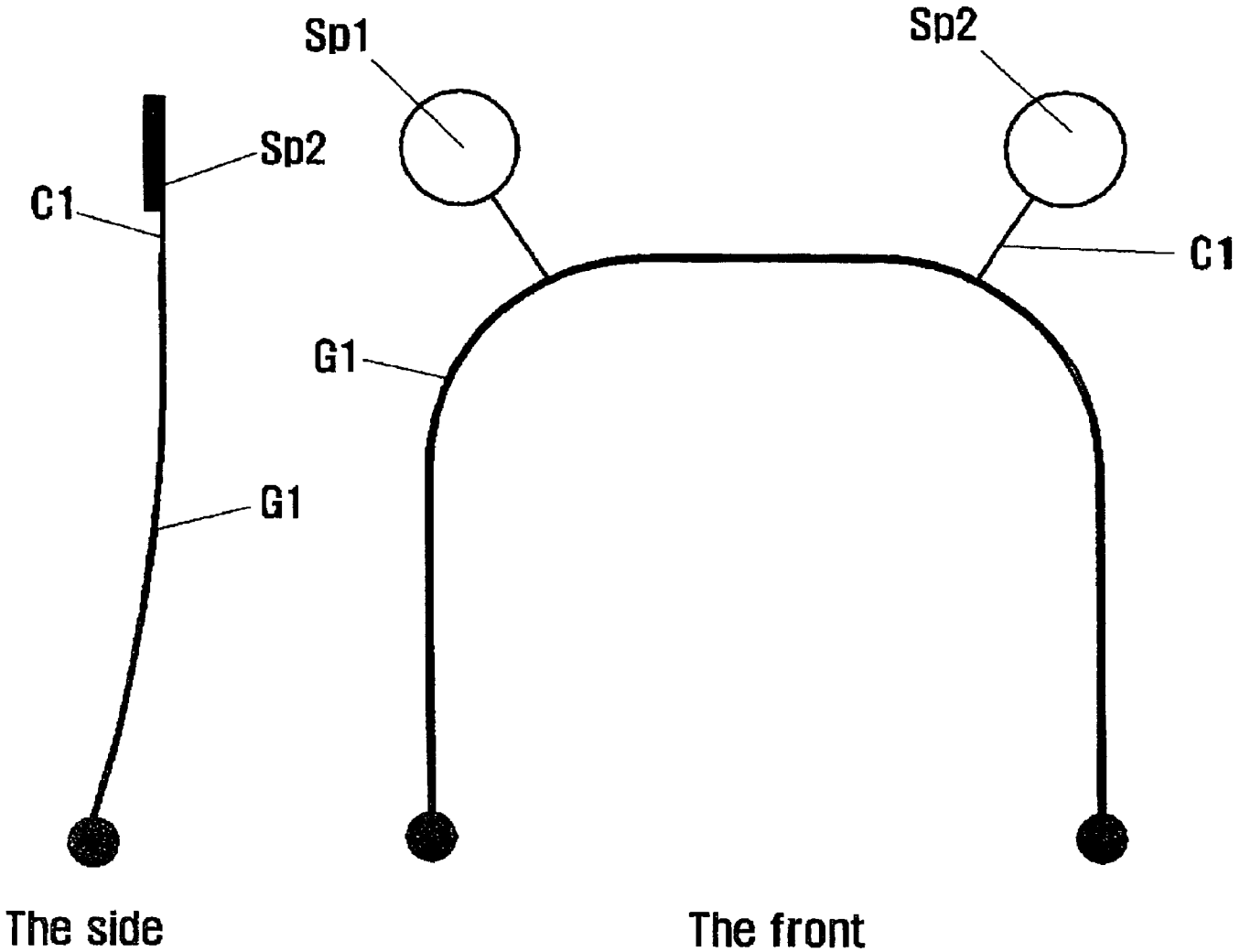
FIG. 6 is a structural view of the neckphone according to a second embodiment of the present invention.

FIG. 6 is a structural view of the neckphone according to the second embodiment of the present invention. The neckphone of FIG. 6 comprises a U-shaped supporting brace G1, speaker portions Sp1 and Sp2 disposed behind the ear, and coupling means C1 for coupling the supporting brace with the speaker portions. The U-shaped supporting brace G1 has an ergomechanics-based curved portion when viewed from the side. The curved portion allows the neckphone to be stably put on the neck and shoulder of the person.

Figure 7:
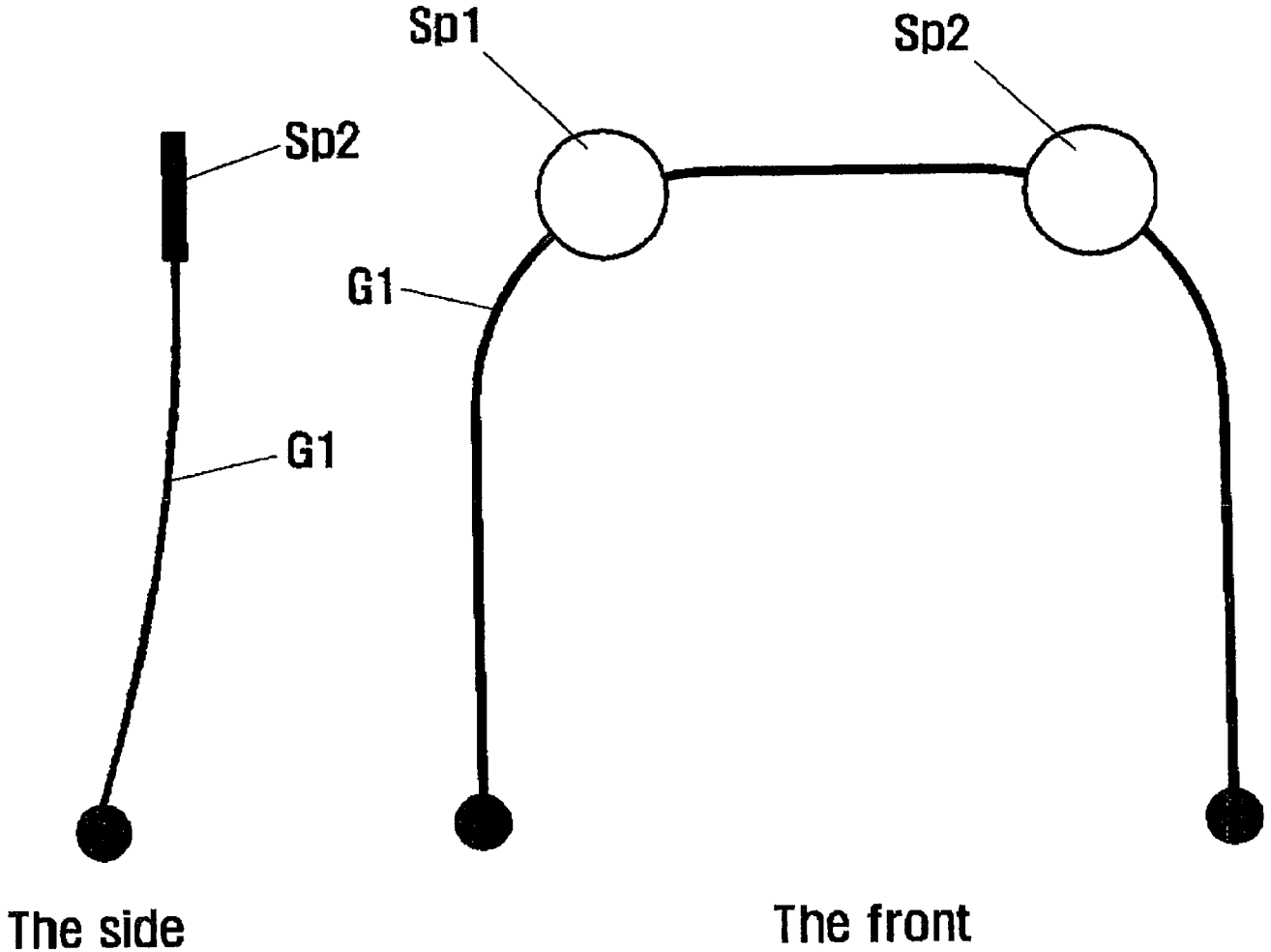
FIG. 7 is a structural view of the neckphone according to a third embodiment of the present invention.

FIG. 7 is a structural view of the neckphone according to the third embodiment of the present invention, wherein the coupling means C1 in the second embodiment is removed and the movement of the speaker portions Sp1 and Sp2 is restrained since the speaker portions Sp1 and Sp2 are directly engaged with the U-shaped supporting brace G1. In addition, the U-shaped supporting brace G1 has an ergomechanics-based curved portion when viewed from the side.

Figure 8:
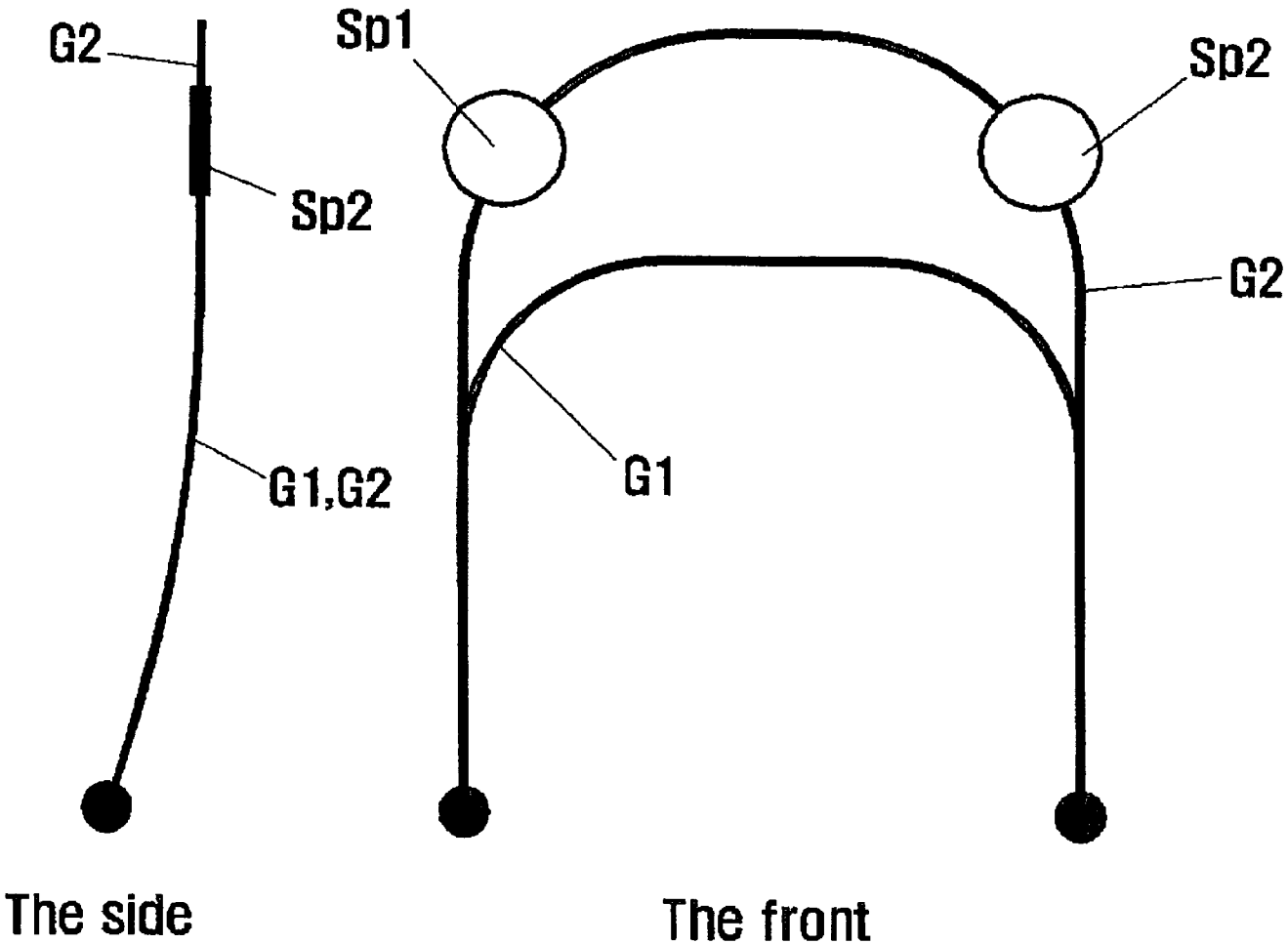
FIG. 8 is a structural view of the neckphone according to a fourth embodiment of the present invention.

FIG. 8 is a structural view of the neckphone according to the fourth embodiment of the present invention, wherein the U-shaped supporting brace G1 used in the second embodiment is still used and the speaker portions Sp1 and Sp2 are engaged with the second supporting brace G2 by adding it to another second supporting brace G2 and wherein the speaker portions Sp1 and Sp2 are fixed to the supporting braces more firmly as compared to the second embodiment. In addition, the U-shaped supporting brace G1 has an ergomechanics-based curved portion when viewed from the side.

Figure 9:
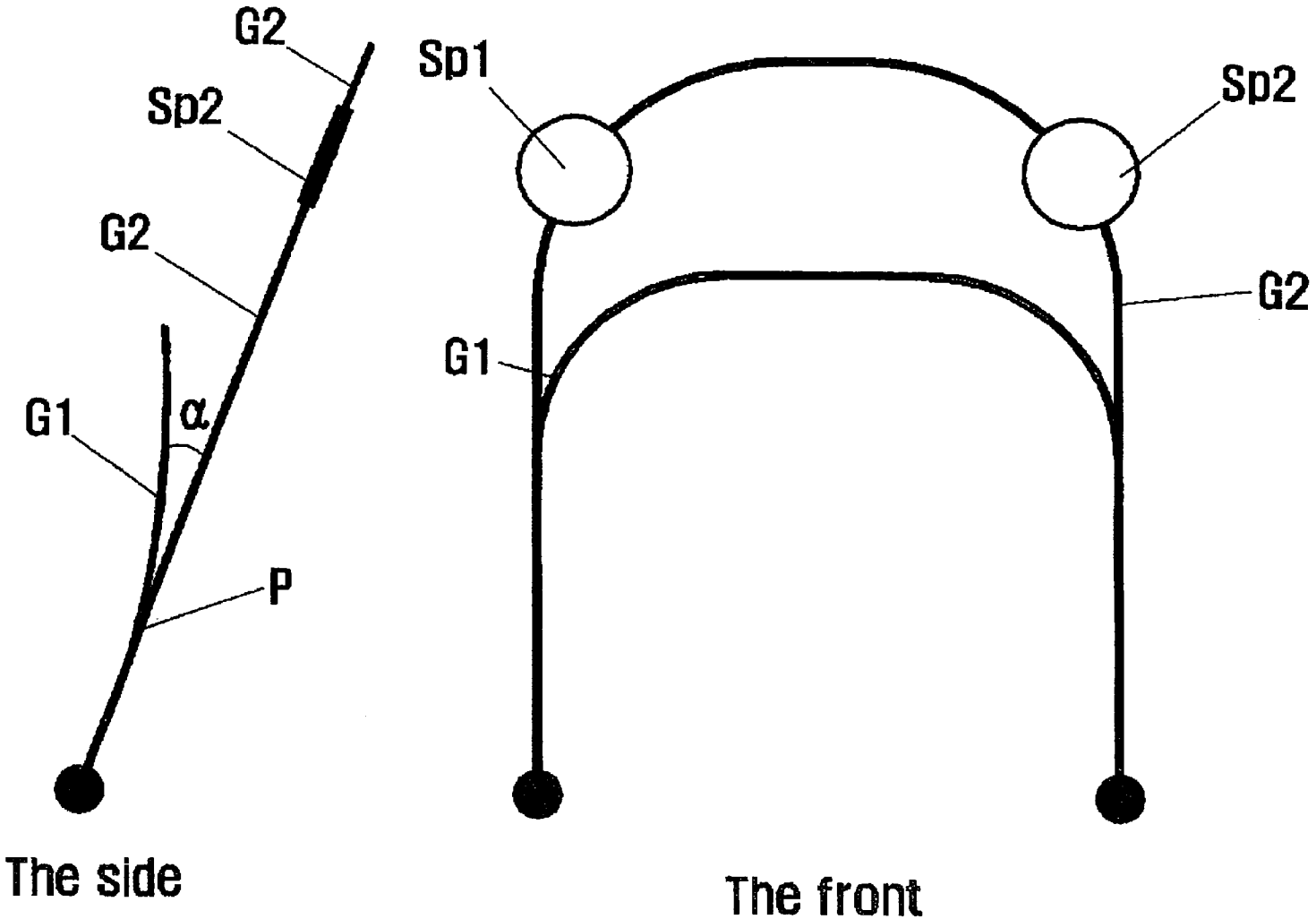
FIG. 9 is a structural view of the neckphone according to a fifth embodiment of the present invention.

FIG. 9 is a structural view of the neckphone according to the fifth embodiment of the present invention, wherein the neckphone has the same structure as the fourth embodiment when viewed from the front. However, when viewed from the side, the speaker portions Sp1 and Sp2 can be positioned closer behind the ear by spacing apart the supporting braces G1 and G2 from location P at a predetermined angle $\alpha$.

Figure 10:
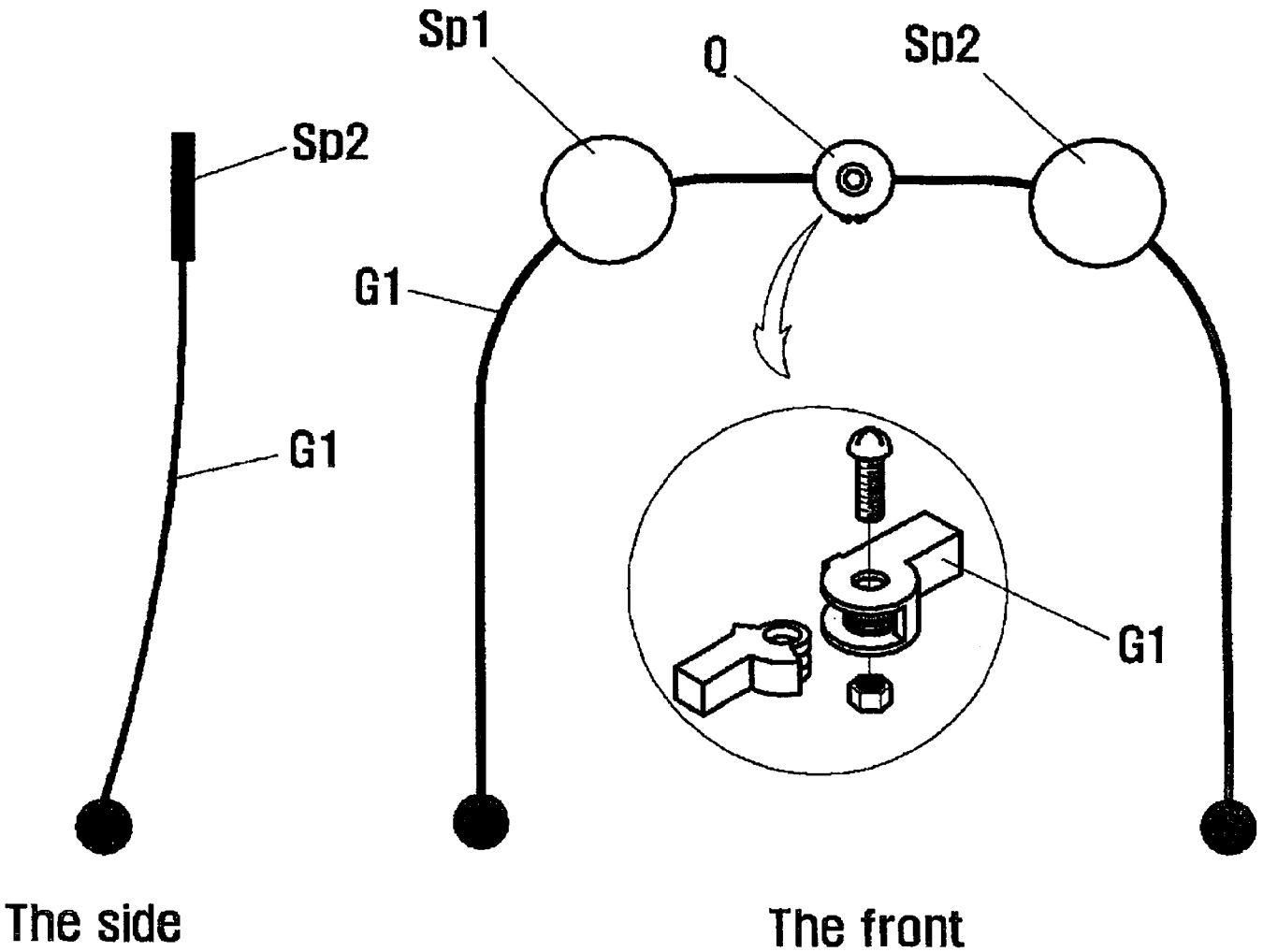
FIG. 10 is a structural view of the neckphone according to a sixth embodiment of the present invention.

FIG. 10 is a structural view of the neckphone according to the sixth embodiment of the present invention, wherein the neckphone has substantially the same structure as the third embodiment except that the supporting brace G1 is divided into two parts and a folding portion Q is provided at the center of the supporting brace G1. Since the two parts of the supporting brace G1 are engaged with each other in the form of a conventional screw engagement by the folding portion Q, the folding portion Q can provide the supporting brace G1 with the mobility in that the supporting brace can move pivotally. Therefore, the user can conveniently wear and carry the neckphone. Furthermore, one or more folding portions Q may be provided, if desired.

Figure 11:
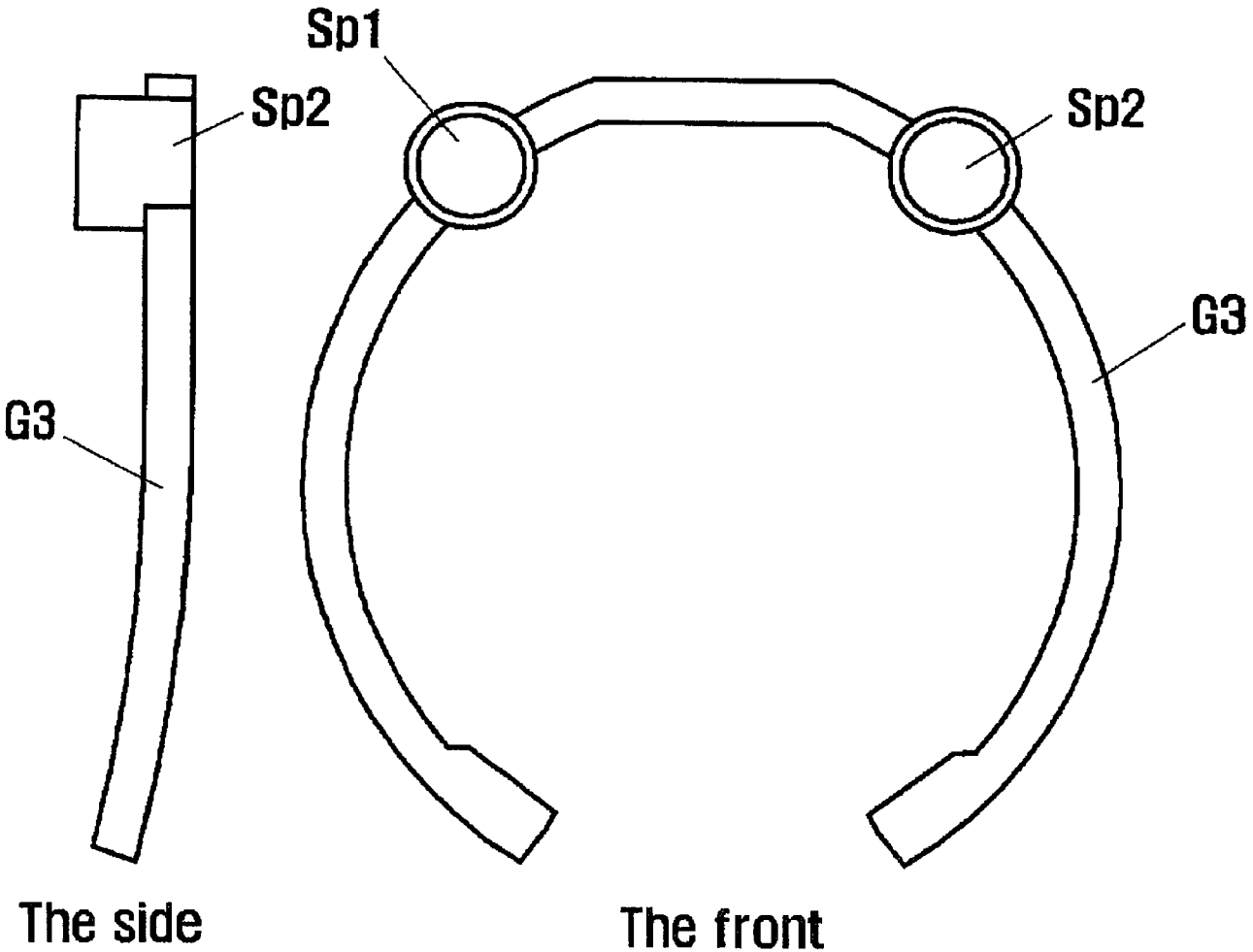
FIG. 11 is a structural view of the neckphone according to a seventh embodiment of the present invention.

FIG. 11 is a structural view of the neckphone according to a seventh embodiment of the present invention and is a variant of the third embodiment. That is, the C-shaped supporting brace G3 is used in the seventh embodiment whereas the U-shaped supporting brace G1 is used in the third embodiment. In the present embodiment, the C-shaped supporting brace G3 may be made from a flexible material.

Figure 12:
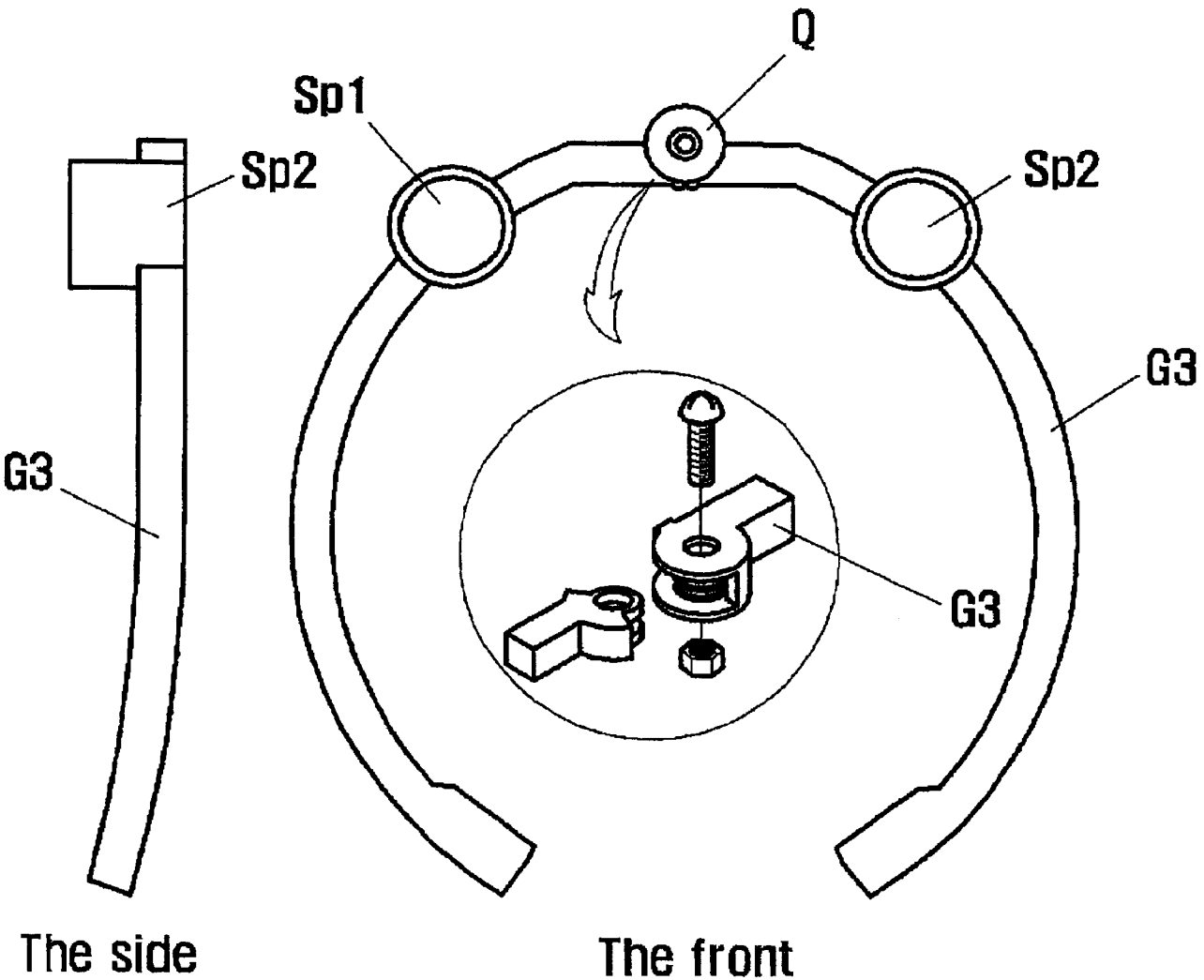
FIG. 12 is a structural view of the neckphone according to a eighth embodiment of the present invention.

FIG. 12 is a structural view of the neckphone according to the eighth embodiment of the present invention, wherein the neckphone has substantially the same structure as the third embodiment except that the supporting brace G3 is divided into two parts and a folding portion Q is provided at the center of the supporting brace G3. The folding portion Q of the eighth embodiment can also make the two parts of the supporting brace G3 be engaged with each other and make the supporting brace G3 move pivotally. Thus, the user can conveniently wear and carry the neckphone. Furthermore, one or more folding portions Q may be provided, if desired.

Figure 13:
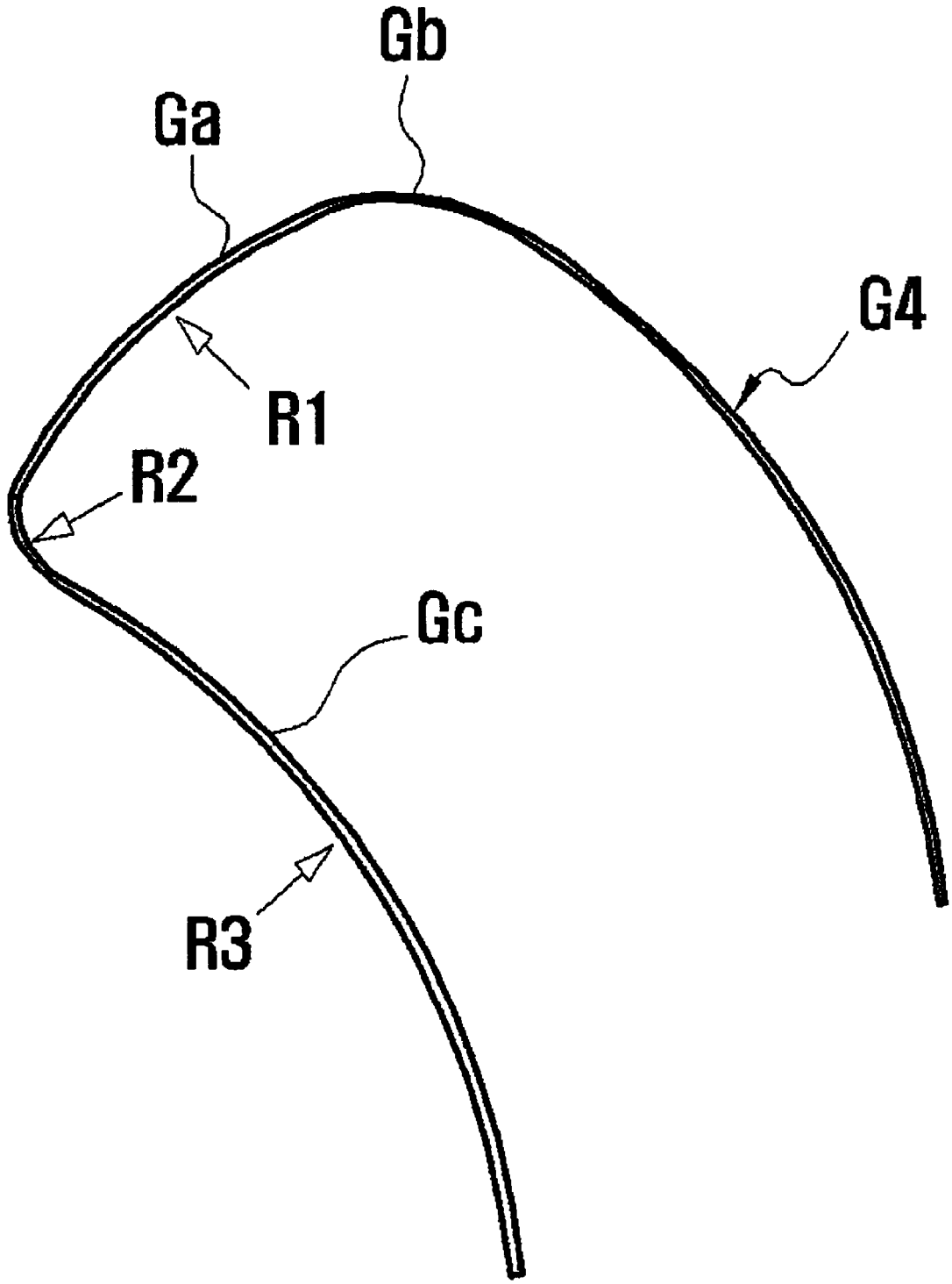
FIGS. 13 and 14 are a perspective view and a side view of the neckphone according to a ninth embodiment of the present invention, respectively.
Figure 14:
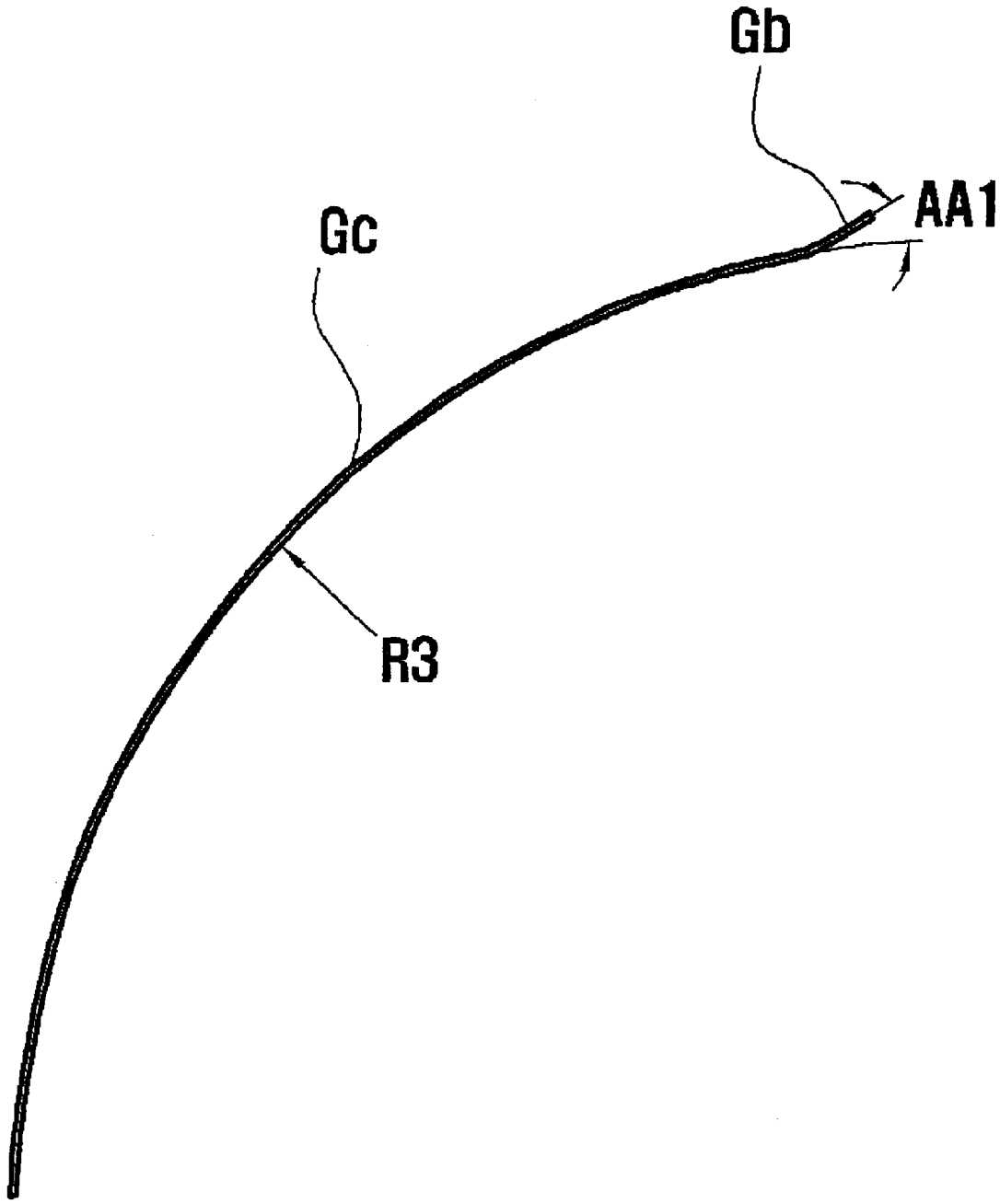

FIGS. 13 and 14 are a perspective view and a side view of the neckphone according to a ninth embodiment of the present invention, respectively. The neckphone of FIGS. 13 and 14 comprises a ∪-shaped supporting brace G4 and speaker portions Sp1 and Sp2. The ∪-shaped supporting brace G4 includes three parts which correspond, respectively, to a first curved portion Ga coupled with the speaker portions (not shown) and having a radius of R1, second curved portions Gb extending from both sides of the first curved portion and taking on a curved shape conforming to the user's neck and having a radius of R2, and third curved portions extending from both sides of the second curved portions and taking on the curved shape of the user's chest and having a radius of R3. The neckphone as constructed above can provide the user when worn with a greater feeling of comfort due to the close contact of the neckphone with the chest and the neck.

Although it is not fully described from the second embodiment to the ninth embodiment of the present invention mentioned above, it should be understood that in a case where the speaker line is connected to one side of the supporting brace, a counterbalancing portion can be incidentally added to the other side of the supporting brace as in the first embodiment, in order to solve a problem that the one side thereof does not have a center of gravity balance with the other side thereof.

Figure 15:
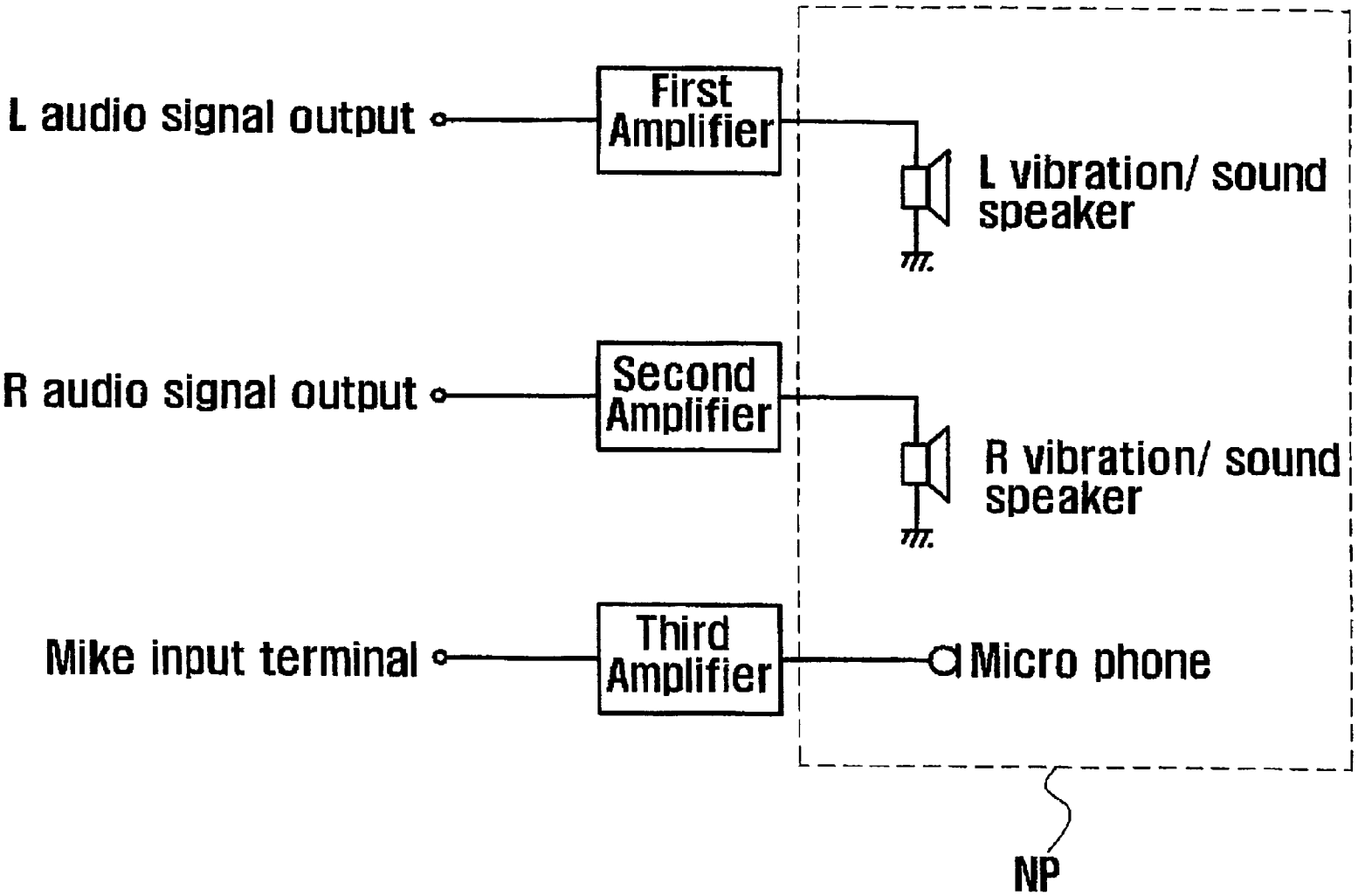
FIG. 15 is a view illustrating that the speaker portion of the neckphone according to the present invention can convert an audio signal into an oscillating force or a sound based on the frequency range and that the neckphone can further include a microphone.

FIG. 15 is a view illustrating that the speaker portion of the neckphone according to the present invention can convert an audio signal into the oscillating force or sound, and that the neckphone can further include a microphone.

Heretofore, in addition to a sound generating device (for example, a speaker), a vibration generating device (for example, a motor) had to be separately required for functional transfer of specific actions in a 3D game. Furthermore, separate software was required for transferring the oscillating force according to the conditions of the game.

However, as understood from FIG. 15, since the speaker portion of the present invention has a structure in that a low frequency contained in an audio signal for reproducing a sound can generate a vibration, no separate vibration generating device is needed. For example, electrical audio signals supplied from L/R audio signal outputs of the sound card are amplified through first and second amplifiers, and then, transmitted to respective L/R speaker portions. The speaker portion converts the audio signals in the range of about 80 to 220 Hz into the oscillating force and the audio signals in the range above 220 Hz into the sounds, so that it can generate the oscillating force for functional transfer of specific actions in a 3D game without an additional vibration generating device.

Moreover, the neckphone according to the present invention may further include a microphone and can be used for various applications such as recording or an internet phone, using the microphone.

INDUSTRIAL APPLICABILITY

According to the present invention constructed as such, a person can enjoy a 3D sound even in a narrow space since the neckphone is a neck-wearing type.

In addition, since the neckphone is provided with the folding portion at the supporting brace thereof, a person can conveniently carry and wear the neckphone.

Furthermore, since it is not an ear-contacting type, it is sanitary and produces less fatigue rather than a conventional earphone and headphone.

Although the present invention has been described in detail with respect to the preferred embodiments of the present invention, it should be understood that a person having an ordinary skill in the art to which the present invention pertains can make various modifications and changes to the present invention without departing from the spirit and scope of the invention defined by the appended claims. Therefore, further modifications to the embodiments of the invention will fall within the scope of the invention.

What is claimed is:

1. A neckphone comprising:

a U-shaped supporting brace, speaker portions for generating sound sources, first coupling portions for coupling said speaker portions and said supporting brace, a second coupling portion for securing a speaker line into said supporting brace, and a counterbalancing portion disposed on the side opposite to said second coupling portion for preventing imbalance in the center of gravity of said neckphone due to the connection of said speaker line.

2. The neckphone as claimed in claim 1, wherein said supporting brace includes an ergomechanics-based, curved portion.

3. The neckphone as claimed in claim 1, wherein said speaker portions are adapted to generate a vibration by a low frequency contained in an audio signal for producing a sound.

4. The neckphone as claimed in claim 1, further including a microphone.

5. A neckphone comprising:

a U-shaped supporting brace, speaker portions, and coupling means for coupling said supporting brace and said speaker portions, wherein in a case where a speaker line is connected to one side of said supporting brace, a counterbalancing portion is added to the other side of said supporting brace, which said speaker line is not connected to, for solving a problem that the center of gravity of said one side of said supporting brace does not balance with that of the other side of said supporting brace.

6. The neckphone as claimed in claim 5, wherein said supporting brace includes an ergomechanics-based, curve portion.

7. The neckphone as claimed in claim 5, wherein said speaker portions are adapted to generate a vibration by a low frequency contained in an audio signal for producing a sound.

8. The neckphone as claimed in claim 5, further including a microphone.

9. A neckphone comprising:

a U-shaped supporting brace, speaker portions, said said supporting portion and said speaker portions being integrally coupled together, wherein in a case where a speaker line is connected to one side of said supporting brace, a counterbalancing portion is added to the other side of said supporting brace, which said speaker line is not connected to, for solving a problem in that the center of gravity of said one side of said supporting brace does not balance with that of the other side of said supporting brace.

10. The neckphone as claimed in claim 9, wherein said supporting brace includes an ergomechanics-based, curved portion.

11. The neckphone as claimed in claim 9, wherein said speaker portions are adapted to generate a vibration by a low frequency contained in an audio signal for producing a sound.

12. The neckphone as claimed in claim 10, further including a microphone.

13. A neckphone comprising:

a first U-shaped supporting brace, a second U-shaped supporting brace coupled with said first U-shaped supporting brace, and speaker portions integrally coupled with said second U-shaped supporting brace, wherein in a case where a speaker line is connected to one side of said supporting brace, a counterbalancing portion is added to the other side of said supporting brace, which said speaker line is not connected to, for solving a problem in that the center of gravity of one side of said supporting brace does not balance with that of the other side of said supporting brace.

14. The neckphone as claimed in claim 13, wherein said first U-shaped supporting brace is installed to be spaced at a predetermined angle from coupling points with said second U-shaped supporting brace.

15. The neckphone as claimed in claim 13 or claim 14, wherein said supporting brace includes an ergomechanics-based, curved portion.

16. The neckphone as claimed in claim 13, wherein said speaker portions are adapted to generate a vibration by a low frequency contained in an auto signal for producing a sound.

17. The neckphone as claimed in claim 13, further including a microphone.

18. A neckphone comprising:

a U-shaped supporting brace separable into a first part and a second part, speaker portion coupled with said U-shaped supporting brace, respectively, and a folding portion for coupling said first and second parts of said supporting brace to provide mobility of said supporting brace, wherein a case where a speaker line is connected to one side of said supporting brace, a counterbalancing portion is added to the other side of said supporting brace, which said speaker line is not connected to, for solving a problem in that the center of gravity of said one side of said supporting brace does not balance with that of the other side of said supporting brace.

19. The neckphone as claimed in claim 18, wherein said supporting brace includes an ergomechanics-based, curved position.

20. The neckphone as claimed in claim 18, wherein said speaker portions are adapted to generate a vibration by a low frequency contained in an audio signal for producing a sound.

21. The neckphone as claimed in claim 18, further including a microphone.

22. A neckphone comprising:

a C-shaped supporting brace, and speaker portions integrally coupled with said supporting brace, wherein in a case where a speaker line is connected to one side of said supporting brace, a counterbalancing portion is added to the other side of said supporting brace, which said speaker line is not connected to, for solving a problem in that the center of gravity of said one side of said supporting brace does not balance with that of the other side of said supporting brace.

23. The neckphone as claimed in claim 22, wherein said supporting brace includes an ergomechanics-based, curved portion.

24. The neckphone as claimed in claim 22, wherein said speaker portions are adapted to generate a vibration by a low frequency contained in an audio signal for producing a sound.

25. The neckphone as claimed in claim 22, further including a microphone.

26. A neckphone comprising:

a C-shaped supporting brace separable into a first part and a second part, speaker portions coupled with said C-shaped supporting brace, respectively, and a folding portion for coupling said first and second parts of said supporting brace to provide mobility of said supporting brace wherein in a case where a speaker line is connected to one side of said supporting brace, a counterbalancing portion is added to the other side of said supporting brace, which said speaker line is not connected to, for solving a problem in that the center of gravity of said one side of said supporting brace does not balance with the other side of said supporting brace.

27. The neckphone as claimed in claim 26, wherein said supporting brace includes an ergomechanics-based, curved portion.

28. The neckphone as claimed in claim 26, wherein said speaker portions are adapted to generate a vibration by a low frequency contained in an audio signal for producing a sound.

29. The neckphone as claimed in claim 26, further including a microphone.

30. A neckphone comprising:

a U-shaped supporting brace G4;

a speaker portions Sp1 an Sp2; and said U-shaped supporting brace G4 including a first curved portion Ga coupled with said speaker portions and having a radius of R1, second curved portion Gb extending from both sides of said first curved portion, taking the shape of the curve of one's neck and having a radius of R2, and third curved portions extending from both sides of said second curved portions, taking the shape of the curve of one's chest and having a radius of R3, wherein in a case where a speaker line is connected to one side of said supporting brace, a counterbalancing portion is added to the other side of said supporting brace, which said speaker line is not connected to, for solving a problem in that the center of gravity of said one side of said supporting brace does not balance with that of the other side of said supporting brace.

31. The neckphone as claimed in claim 30, wherein said speaker portions are adapted to generate a vibration by a low frequency contained in an audio signal for producing a sound.

32. The neckphone as claimed in claim 30, further including a microphone.

* * * * *